United States Patent [19]

Mifune et al.

[11] 4,274,185

[45] Jun. 23, 1981

[54] ROLL ASSEMBLY FOR USE IN ROLLING A WIRE ROD

[75] Inventors: Teruo Mifune; Keiji Noto, both of Muroran; Yasuo Otsu, Amagasaki; Kotaro Hagiwara, Takarazuka, all of Japan

[73] Assignee: Sumitomo Electric Industries, Ltd., Tokyo, Japan

[21] Appl. No.: 125,748

[22] Filed: Feb. 28, 1980

Related U.S. Application Data

[63] Continuation of Ser. No. 812,627, Jul. 5, 1977, abandoned.

[51] Int. Cl.[3] ..... B21B 31/08

[52] U.S. Cl. ..... 29/123; 29/125

[58] Field of Search ..... 29/427, 148.4 D, 446, 29/450, 507, 113 R, 123, 125, 130; 72/238

[56] References Cited

U.S. PATENT DOCUMENTS

| | | | |
|---|---|---|---|
| 2,348,293 | 5/1944 | Hamer | 29/427 U X |
| 2,980,474 | 4/1961 | Gargan | 29/427 UX |
| 3,104,459 | 9/1963 | Wendt | 29/427 X |
| 3,461,527 | 8/1969 | Strandell | 29/123 |
| 3,902,233 | 9/1975 | Ohsu | 29/125 |
| 4,115,910 | 9/1978 | Hertel et al. | 29/123 |

*Primary Examiner*—Milton S. Mehr

*Attorney, Agent, or Firm*—Wenderoth, Lind & Ponack

[57] ABSTRACT

A roll assembly for use in rolling a wire rod includes an arbor which has a slightly tapered periphery at the middle portion thereof, a liquid pressure applying channel provided in the arbor extending to the tapered periphery, a cemented carbide sleeve securely fitted about the tapered periphery, opposing tightening means securely holding the sleeve by constricting it at around both ends, and a roll neck bearing mounted around each end portion of the arbor.

For assembling the roll assembly, liquid pressure is applied through the channel provided in the arbor so as to form a liquid layer between the sleeve and tapered periphery of the arbor.

5 Claims, 7 Drawing Figures

ROLL ASSEMBLY FOR USE IN ROLLING A WIRE ROD

This is a continuation of application Ser. No. 812,627, filed July 5, 1977, abandoned.

The present invention relates to a roll assembly for use in hot-rolling a wire rod.

As shown in FIG. 1, the conventional roll assembly comprises an arbor 10, a cemented carbide sleeve 11 securely fitted around the arbor 10, the sleeve 11 having an annular groove 12, a constriction nut 13 threaded on the arbor 10 at each end of the sleeve 11 so as to securely hold it, a fillet ring 14 shrink-fitted around the arbor on the outside of each nut 13 so as to prevent water, scale and the like from entering a bearing casing which is mounted at each end of the arbor, and a roll neck bearing 15 shrink-fitted around each end of the arbor in the bearing casing. The thus constructed roll assembly for use in rolling a wire and the like is generally called a sleeve roll.

As to the sleeve roll, very high precision is required not only for the production of essential parts such as the sleeve, arbor and constriction nut, but also for the technique of assembling the parts and for the completed roll assembly itself. Therefore, once the roll assembly is completed by a manufacturer, disassembling of the roll is neither performed nor thought to be necessary so long as any trouble does not occur during operation.

The thus produced roll assembly has no disadvantage in practical use as long as it is applied to the production of large quantities in a few kinds of sizes of wire. However, when applied to the production of small quantities of wire in a variety of sizes, there must be prepared a great number of sleeve rolls, resulting not only in complicating the use but also in a large initial investment. Therefore, advantages such as abrasion resistance of the sleeve roll are partially offset.

For the purpose of use in making small quantities of wire of various sizes, the cemented carbide sleeve is provided with more than two different annular grooves, each of which is adapted to roll a different size of wire. However, unless the amount of each wire rolled is not balanced, the unit roll consumption (amount of roll wear per unit amount rolled) increases greatly. Therefore, this structure is also not practical.

For the reasons described above, there is a strong demand for a sleeve roll which can be readily disassembled and assembled by the user.

A primary object of the present invention is to provide a sleeve roll which meets the above requirements.

A further object of the present invention is to provide a sleeve roll which is possible to easily assemble and disassemble.

Other objects and features of the present invention will be apparent from the following description of the invention with reference to the accompanying drawings, in which.

Throughout the drawings, similar parts and elements are designated by similar reference numerals.

Figure 2:
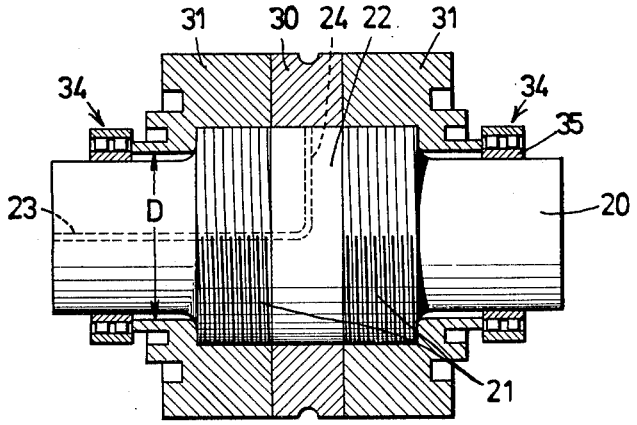
FIGS. 2 through 4 are longitudinally sectioned views illustrating sleeve rolls of the invention.

Referring now to FIG. 2, an arbor 20 of a sleeve roll is provided with threads 21 axially spaced from each other. Between the threads 21 is formed a slightly tapered periphery 22. An axial channel 23 extends from one end of the arbor 20 to the middle portion, and a radial channel 24 communicating with the axial channel 23 extends to the tapered periphery 22. There may be provided a plurality of channels 24 communicating with the channel 23. Also a plurality of channels 23 can be provided.

Figure 1:
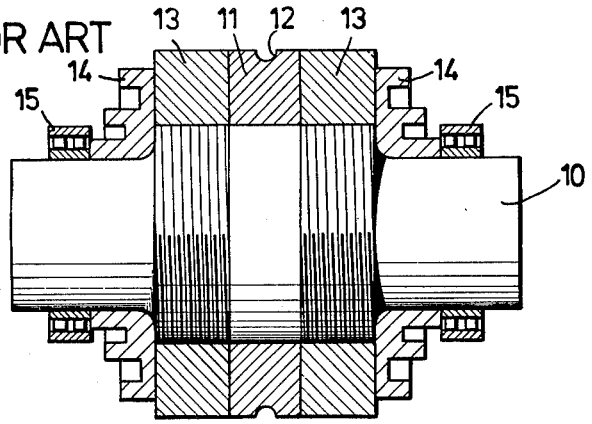
FIG.1 PRIOR ART
FIG. 1 is a longitudinally sectioned view showing a prior art sleeve roll.

Around the tapered periphery 22 of the arbor 20 is securely fitted a cemented carbide sleeve 30 having at least one annular groove. At each end of the sleeve 30 is a tightening ring 31 threaded on each of the threads 21. As appears from FIGS. 1 and 2, the conventional constriction nut 13 and fillet ring 14 are combined together to form the tightening ring 31 of the invention. As will be understood, the outer end portion of the ring 31 serves as a conventional fillet ring.

Around the arbor 20 outwardly of the ring 31 is mounted a roll neck bearing 34. Inner race 35 thereof is shrink-fitted around the arbor 20.

In order to permit easy disengagement of the ring 31, the inner diameter D thereof may be slightly larger than the outer diameter of the inner race 35 which is shrink-fitted around the arbor 20.

Figure 3:
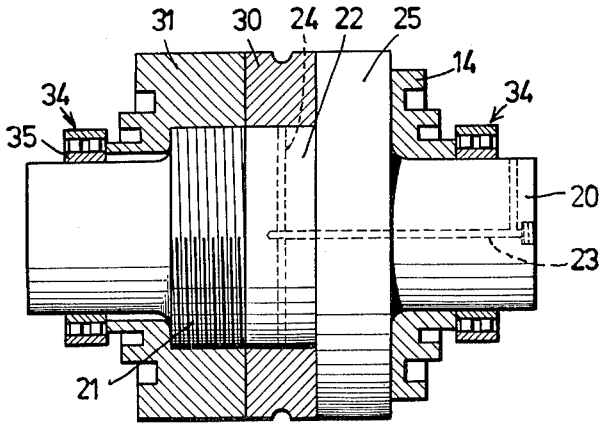

FIG. 3 shows a modified sleeve roll. As shown, a collar 25 is integrally formed with the arbor 20. The single tightening ring 31 presses the sleeve 30 against the collar 25. Abutting the outer face of the collar 25 is a conventional fillet ring 14. As appears, the inlet of the channel 23 may be open to the outer periphery of the arbor 20 at a portion other than the tapered periphery 22.

Figure 4:
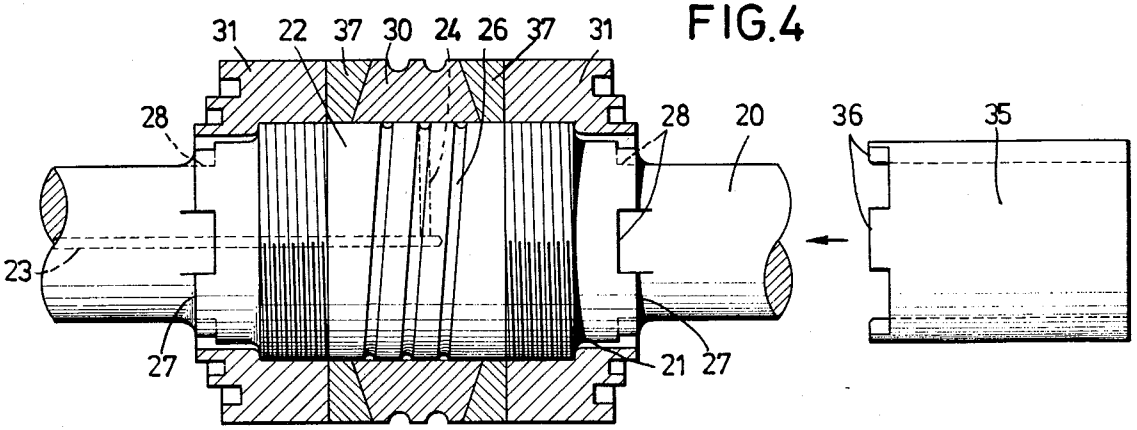
Figure 5:
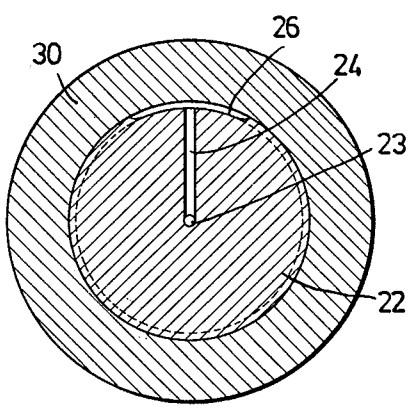
FIG. 5 is a transverse cross sectional view of a sleeve roll of FIG. 4.

As shown in FIGS. 4 and 5, annular or helical grooves 26 may be provided around the tapered periphery 22 in communication with the channel 24. Although not shown in the drawings, such annular or helical grooves may alternatively be provided in the inner periphery of the sleeve 30.

As is apparent from FIG. 4, in each of shoulders 27 formed around the arbor 20 may be provided recesses 28 engageable with projections 36 formed at the end of the inner race 35 of the bearing 34. The structures are provided for preventing relative rotation between the arbor 20 and inner race 35 due to excessive load, vibration or unusual lubrication during operation. Further, as illustrated, between the sleeve 30 and the ring 31 can be interposed fixing ring 37 having a radially tapered inner face, which prevents broken pieces of the sleeve 30 from scattering if it happens to be destroyed.

Figure 6:
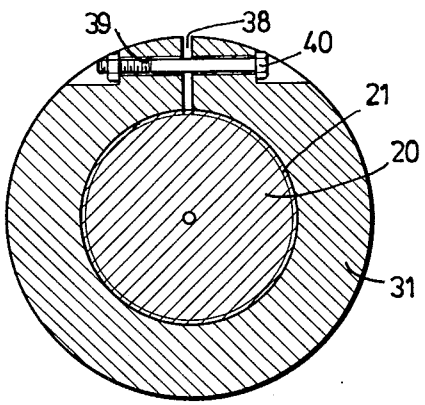
FIG. 6 is a transverse cross sectional view of a sleeve roll incorporating a constricting means.

In order to ensure that the tightening rings 31 securely hold the cemented carbide sleeve 30, there may be provided constricting means in each of the rings 31. As illustrated in FIG. 6, the ring 31 is split at 38, and a hole 39 extends across the periphery of the ring 31 as well as the split 38. In the hole 39 is inserted a bolt 40 used to tighten the ring 31.

Figure 7:
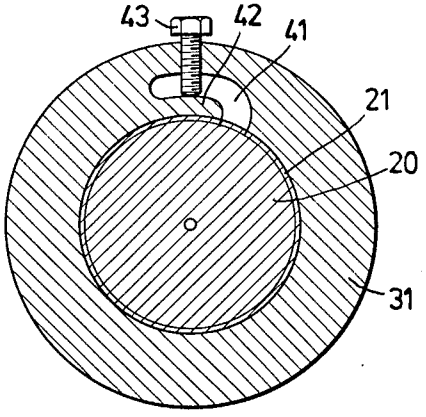
FIG. 7 is a transverse cross sectional view showing another constricting means.

As shown in FIG. 7, there may be provided in the ring 31 an axially extending slit 41 having a J-shaped section to form a tongue-like piece 42. A bolt 43 is radially threaded into the periphery of the ring 31 so that the inner end of the bolt 43 abuts the tongue-like piece 42 to press it against the arbor 20.

Although only two examples are illustrated above, any other constricting means can be employed.

With the roll assembly of the present invention as described hereinbefore in detail, upon assembling the roll, initially the cemented carbide sleeve 30 is put around the arbor 20 adjacent the tapered periphery 22 thereof. Then, the sleeve 30 is forcedly pushed towards the taper 22 while applying liquid pressure such as oil pressure through the channels 23 and 24. As the liquid pressure is increased, the sleeve 30 is permitted to fit about the taper 22 at the position where the allowance is provided by the pressure of liquid. At this time, a push slightly stronger than the axial component of a force caused only by the inclination of taper 22 is enough for forcing the sleeve 30 to fit around the taper 22. No other force such as the axial component counterforce due to friction will act on the sleeve 30.

After the sleeve is fitted at a predetermined position, the liquid pressure is released. Thus the sleeve directly and tightly fits around the tapered periphery 22 of the arbor 20.

In contrast to the above, in the conventional sleeve roll, a very great force must be applied to the sleeve so as to overcome the axial component counterforce due to friction. As a result, it is inevitable that the tapered periphery 22 will be scratched or abraded. Further, it is very difficult to apply uniform pressure to the sleeve. Therefore, the sleeve may sometimes be broken.

When it is desired to exchange the sleeve 30, the outer races of the roll neck bearings 34 are disengaged. The rings 31 are then loosened from the threads 21 and are removed from the arbor 20 over the inner races 35. The removal can be readily performed since the inner diameter of the ring 31 is adapted to be larger than the outer diameter of the inner race 35.

In the conventional roll, however, the removal of bearings 15 and fillet rings 14 (FIG. 1) requires heating the roll assembly since both of them are shrink-fitted around the arbor 10. The heating produces bad influences on the arbor as well as the bearings and fillet rings. Moreover, this requires much labour and time.

After the removal of rings 31, the sleeve 30 is to be disengaged. For this purpose, liquid pressure is applied through the channels 23 and 24 to form a liquid layer between the sleeve 30 and tapered periphery 22. Then the sleeve 30 can be readily pulled off the arbor.

As described above, according to the present invention, the cemented carbide sleeve can be readily exchanged by the application of liquid pressure through the channel extending to the tapered periphery around which the sleeve is securely fitted.

Further, quicker and easier exchange of the sleeve can be performed by a modified tightening ring which comprises a constriction nut combined with a fillet ring, and which has an inner diameter slightly larger than the outer diameter of the inner race of the roll neck bearing. The structures enable ready disengagement of the tightening ring without removing the inner race of the bearing which has been shrink-fitted by the application of heat, and without removing the fillet ring which has also been shrink-fitted on the conventional sleeve roll. Therefore, the exchange efficiency can be remarkably improved.

Still further, the cost for preparing various rolls and storage space therefor can be greatly reduced.

What is claimed is:

1. A roll assembly for use in rolling a wire rod comprising an arbor having a slightly tapered periphery at the middle portion thereof, a liquid pressure applying channel provided in the arbor extending to the tapered periphery, a cemented carbide sleeve fitted with an interference fit around the tapered periphery, opposing tightening means securely holding the sleeve by constricting it at both ends, and a roll neck bearing mounted around each end portion of the arbor, at least one of said opposing tightening means being a tightening ring threaded onto the arbor, the ring having an integral fillet member at the end remote from the sleeve with the inside diameter of the fillet member being larger than the outside diameter of the inner race of the roll neck bearing.

2. A roll assembly as claimed in claim 1, wherein both of the opposing tightening means comprises a tightening ring threaded onto the arbor, the ring having an integral fillet member at the end thereof remote from said sleeve, the fillet member having an inside diameter larger than the outside diameter of the inner race of the roll neck bearing.

3. A roll assembly as claimed in claim 1, wherein the other opposing tightening means comprise a collar integrally formed around the arbor said tightening ring being threaded around the arbor to press the sleeve against the collar.

4. A roll assembly as claimed in claim 1, further comprising a groove provided in the tapered periphery in communication with the liquid pressure applying channel.

5. A roll assembly as claimed in claim 1, wherein the sleeve has a groove in its inner periphery for communicating with the liquid pressure applying channel.

* * * * *